US012735828B2

(12) United States Patent
Xiao et al.

(10) Patent No.: US 12,735,828 B2
(45) Date of Patent: Sep. 15, 2026

(54) DISPENSING SYSTEM OF LAUNDRY TREATMENT APPARATUS, AND LAUNDRY TREATMENT APPARATUS HAVING SAME

(71) Applicant: Wuxi Little Swan Electric Co., Ltd., Wuxi (CN)

(72) Inventors: Yi Xiao, Wuxi (CN); Shibo Fu, Wuxi (CN); Shulin Yan, Wuxi (CN); Wenjing Liao, Wuxi (CN); Zhongzhi Zhang, Wuxi (CN)

(73) Assignee: Wuxi Little Swan Electric Co., Ltd., Wuxi (CN)

( * ) Notice: Subject to any disclaimer, the term of this patent is extended or adjusted under 35 U.S.C. 154(b) by 207 days.

(21) Appl. No.: 18/563,281

(22) PCT Filed: May 31, 2022

(86) PCT No.: PCT/CN2022/096389
§ 371 (c)(1),
(2) Date: Nov. 21, 2023

(87) PCT Pub. No.: WO2022/253244
PCT Pub. Date: Dec. 8, 2022

(65) Prior Publication Data

US 2024/0376659 A1 Nov. 14, 2024

(30) Foreign Application Priority Data

May 31, 2021 (CN) ..... 202110602159.0

(51) Int. Cl.
*D06F 39/08* (2006.01)
*D06F 33/37* (2020.01)
*D06F 105/42* (2020.01)

(52) U.S. Cl.
CPC ..... *D06F 39/088* (2013.01); *D06F 33/37* (2020.02); *D06F 2105/42* (2020.02)

(58) Field of Classification Search
None
See application file for complete search history.

(56) References Cited

U.S. PATENT DOCUMENTS

2009/0293556 A1 12/2009 Lee et al.
2020/0232147 A1* 7/2020 Jung ..... D06F 39/02

FOREIGN PATENT DOCUMENTS

CN 101307556 A 11/2008
CN 203374479 U 1/2014
(Continued)

OTHER PUBLICATIONS

CN 206204621 U Espacenet translation, A Detergent Throwing Equipment Of Washing Machine And Washing Machine, Ji (Year: 2017).*

(Continued)

*Primary Examiner* — Cristi J Tate-Sims
(74) *Attorney, Agent, or Firm* — Anova Law Group, PLLC

(57) ABSTRACT

A dispensing system includes a liquid storage box having a liquid storage cavity and a liquid outlet in communication with the liquid storage cavity, and a liquid mixing box having a liquid mixing cavity and a liquid inlet and a mixed liquid outlet that are in communication with the liquid mixing cavity. The liquid mixing box includes a visible region through which the liquid mixing cavity is observable. The dispensing system further includes a dispensing device connected to the liquid outlet and the liquid inlet. The dispensing device is configured to deliver a detergent in the liquid storage cavity to the liquid mixing cavity.

20 Claims, 12 Drawing Sheets

(56) References Cited

FOREIGN PATENT DOCUMENTS

| | | | | |
|---|---|---|---|---|
| CN | 105256510 | A | 1/2016 | |
| CN | 105951371 | A | 9/2016 | |
| CN | 206204621 | U | 5/2017 | |
| CN | 107938263 | A | 4/2018 | |
| CN | 210975239 | U | 7/2020 | |
| CN | 112011953 | A | 12/2020 | |
| CN | 212223372 | U | 12/2020 | |
| CN | 113279209 | A | 8/2021 | |
| CN | 215714061 | U | 2/2022 | |
| CN | 216338551 | U | 4/2022 | |
| EP | 3744890 | A1 * | 12/2020 | ..... D06F 39/02 |
| KR | 20070090399 | A | 9/2007 | |

OTHER PUBLICATIONS

CN 103485133 A machine translation, Washing Machine And Detergent Drawer Assembly Thereof, Ban (Year: 2014).*

KR 101482111 B1 machine translation, Washing Machine (Year: 2015).*

China National Intellectual Property Administration (CNIPA) Office Action 1 for Application No. 202110693190.X Oct. 25, 2024 38 Pages (including translation).

China National Intellectual Property Administration (CNIPA) Office Action 2 for Application No. 202110693190.X May 10, 2025 23 Pages (including translation).

China National Intellectual Property Administration (CNIPA) Decision of Rejection for Application No. 202110693190.X Jun. 27, 2025 26 Pages (including translation).

The World Intellectual Property Organization (WIPO) Written Opinion for PCT/CN2022/096389 Aug. 31, 2022 11 Pages (including translation).

The World Intellectual Property Organization (WIPO) International Search Report for PCT/CN2022/096389 Aug. 31, 2022 7 pages (including English translation).

Brazilian Patent and Trademark Office (INPI) The Technical Examination Report for BR Application No. BR112023024601-6 Feb. 24, 2026 8 Pages (Translation Included).

* cited by examiner

DISPENSING SYSTEM OF LAUNDRY TREATMENT APPARATUS, AND LAUNDRY TREATMENT APPARATUS HAVING SAME

CROSS-REFERENCE TO RELATED APPLICATION

This application is a National Stage Entry under 35 U.S.C. § 371 of International Application No. PCT/CN2022/096389, filed on May 31, 2022, which claims priority to Chinese Patent Application No. 202110602159.0, titled "DISPENSING SYSTEM OF LAUNDRY TREATMENT APPARATUS, AND LAUNDRY TREATMENT APPARATUS HAVING SAME," and filed by WUXI LITTLE SWAN ELECTRIC CO., LTD. on May 31, 2021, the enter contents of both of which are incorporated herein by reference.

FIELD

The present disclosure relates to the field of manufacturing of laundry treatment apparatuses, and more particularly, to a dispensing system of a laundry treatment apparatus and a laundry treatment apparatus having same.

BACKGROUND

With the change of consumption habits and upgrading of consumption, the use of liquid detergent auxiliaries such as laundry detergents and fabric softeners is increasing. Considering the trouble of manually dispensing a laundry detergent into a washing machine every time and the difficulty in determining an appropriate amount of the dispensed laundry detergent, a washing machine with an "auto-dispensing" function is becoming more and more popular. However, such an "auto-dispensing" function is costly and results in a complex structure. Also, in addition to being limited by an accuracy of a dispensing amount of a dispensing device itself, an accuracy of a dispensing amount of the washing machine with this "auto-dispensing" function depends more on an accuracy of the determination of a laundry load by the washing machine. However, currently, the determination of the laundry load by the washing machine is mostly based on fuzzy weighing, which is of a low accuracy due to influences of differences in ambient temperatures and materials of laundries. Therefore, it is difficult to appropriately match a corresponding automatic dispensing amount of a detergent with an actual laundry load, resulting in problems of insufficient cleaning due to under-dispensing of the detergent and a detergent residual due to over-dispensing of the detergent.

SUMMARY

The present disclosure aims to solve at least one of the technical problems in the related art to some extent.

To this end, embodiments of the present disclosure provide a dispensing system of a laundry treatment apparatus. The dispensing system of the laundry treatment apparatus has advantages of allowing a user to observe an actual dispensing amount and to determine a dispensing amount as desired, low manufacturing costs, and the like.

Embodiments of the present disclosure further provide a laundry treatment apparatus having the dispensing system of the laundry treatment apparatus.

According to an embodiment of the present disclosure, a dispensing system of a laundry treatment apparatus is provided. The dispensing system includes a liquid storage box, a liquid mixing box, and a dispensing device. The liquid storage box has a liquid storage cavity and a first liquid outlet in communication with the liquid storage cavity. The liquid mixing box has a liquid mixing cavity, and a first liquid inlet and a mixed liquid outlet that are in communication with the liquid mixing cavity. The liquid mixing box has a visible region for observing the liquid mixing cavity. The dispensing device is connected to the first liquid outlet and the first liquid inlet. The dispensing device is configured to deliver a detergent in the liquid storage cavity to the liquid mixing cavity.

The dispensing system of the laundry treatment apparatus according to the embodiment of the present disclosure has advantages of allowing the user to observe the actual dispensing amount and to determine the dispensing amount as desired, low manufacturing costs, and the like.

According to an embodiment of the present disclosure, a laundry treatment apparatus is provided. The laundry treatment apparatus includes a machine body having a laundry treatment cavity, and the dispensing system according to the above embodiments of the present disclosure. The mixed liquid outlet of the dispensing system is in communication with the laundry treatment cavity.

Additional aspects and advantages of the present disclosure will be provided at least in part in the following description, or will become apparent at least in part from the following description, or can be learned from practicing of the present disclosure.

DETAILED DESCRIPTION OF THE EMBODIMENTS

Figure 1:
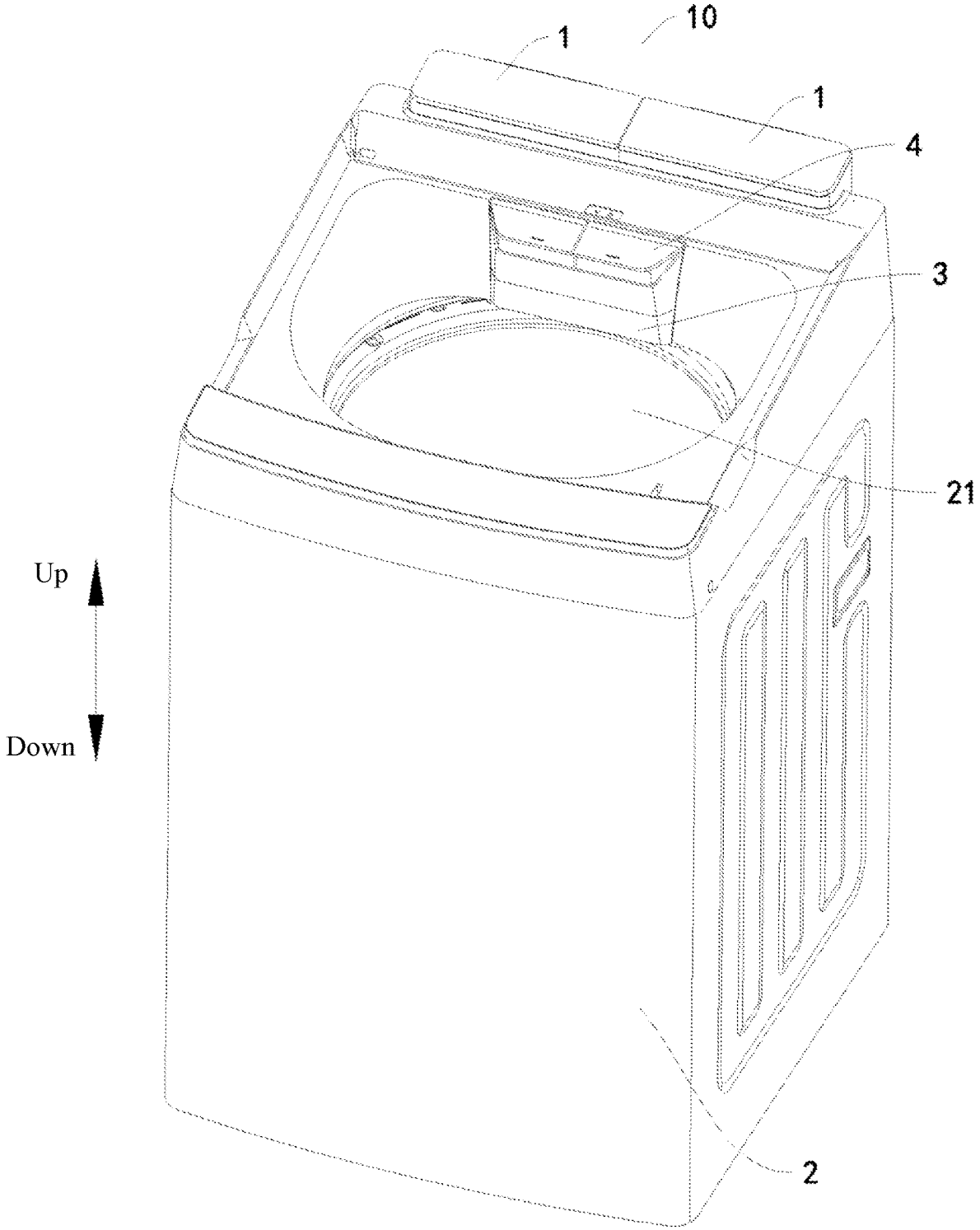
FIG. 1 is a schematic structural view of a laundry treatment apparatus according to some embodiments of the present disclosure.

Embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the drawings are illustrative only, and are intended to explain, rather than limiting, the present disclosure.

A dispensing system of a laundry treatment apparatus 10 according to embodiments of the present disclosure will be described below with reference to the accompanying drawings.

As illustrated in FIG. 1 to FIG. 19, the dispensing system of the laundry treatment apparatus 10 according to the embodiments of the present disclosure may include a liquid storage box 1, a liquid mixing box 3, and a dispensing device 4. For example, the laundry treatment apparatus 10 may be a top load washing machine. The liquid storage box 1 is a device for storing a detergent. The liquid mixing box 3 is a device for mixing the detergent and water. The detergent may be a laundry detergent, a softener, and the like.

In some embodiments, the liquid storage box 1 may have a liquid storage cavity 101 and a first liquid outlet 102. The first liquid outlet 102 is adapted to be in communication with the liquid storage cavity 101. The liquid mixing box 3 may have a liquid mixing cavity 393, a water inlet 31 in communication with the liquid mixing cavity 393 and configured to allow for water inflow, and a first liquid inlet 32 configured to allow for liquid inflow. Clean water and the detergent may be mixed in the liquid mixing cavity 393. The liquid mixing box 3 may further have a mixed liquid outlet 33. A mixed liquid may be discharged out of the liquid mixing box 3 through the mixed liquid outlet 33. The liquid mixing box 3 may further have a visible region 34 for observing the liquid mixing cavity 393. Dispensing condition of the detergent in the liquid mixing box 3A can be observed by a user through the visible region 34. The dispensing device 4 may be connected to the first liquid outlet 102 and the first liquid inlet 32. The dispensing device 4 is configured to deliver a detergent in the liquid storage cavity 101 to the liquid mixing cavity 393.

It should be understood that the dispensing device 4 may be a manual dispensing device 4, which requires the user to achieve a required dispensing amount through one or more manual operations. The dispensing device 4 may also be an electrical dispensing device 4.

With the dispensing system of the laundry treatment apparatus 10 according to the embodiments of the present disclosure, by forming the liquid storage cavity 101, it is possible to allow a predetermined amount of detergent to be stored in the liquid storage cavity 101. For example, the liquid storage cavity 101 can accommodate a bag or a bucket of commercially available detergent. It should be noted that a volume of the liquid storage cavity 101 may be set based on living habits of consumers in the local market. For example, in China, a bag of detergent generally has a volume of 500 ml, and thus the volume of the liquid storage cavity 101 may be set to be at least 500 ml; and in a foreign region, a bag of detergent generally has a volume of 800 ml, and thus the volume of the liquid storage cavity 101 may be set to be at least 800 ml. Since a sufficient amount of detergent is accommodated in the liquid storage cavity 101, an appropriate amount of the detergent in the liquid storage cavity 101 is dispensed into a washing tub based on a washing demand each time laundry is performed. Therefore, it is possible to eliminate need for the user to search for a detergent bag and open the detergent bag to put the detergent into the laundry every time the laundry is performed. By providing the liquid storage box 1, the laundry becomes more convenient, and thus user's operations are simplified.

In some embodiments, in a state where the liquid storage box 1 is mounted in place, an upper end of the liquid storage box 1 may be higher than an upper end of a machine body 2 of the laundry treatment apparatus 10. In this way, the liquid storage box 1 is semi-mounted at the machine body 2, which facilitates an observation of an internal condition of the liquid storage cavity 101 and an access to the liquid storage box 1 by the user. Therefore, it is possible to allow the user to directly observe a liquid stock and a cleanliness condition inside the liquid storage box 1, thereby offering the user an intuitive feeling and reducing a space occupied inside a washing machine without affecting other structures of the washing machine.

In addition, with the liquid mixing box 3, the detergent in the liquid mixing box 3 may be first diluted. The detergent is fully dissolved in water for dilution, and then the diluted detergent is dispensed into the washing tube. As a result, full contact between the detergent and the laundry is implemented, thereby improving cleaning performance of the laundry treatment apparatus 10 on the laundry.

Further, with the visible region 34 formed at the liquid mixing box 3, when the laundry is performed, the user can observe a real dispensing amount of the detergent dispensed into the liquid mixing cavity 393 through the visible region 34 and can control a dispensing amount of the detergent as desired. As a result, the dispensing amount of the detergent is controlled by the user. The user can dispense an appropriate amount of liquid as desired based on concentrations of detergents of different brands, washing characteristics, materials of clothes, a degree of dirtiness of washed objects, types of stains, and other characteristics that cannot be currently recognized by the washing machine. The dispensing amount is real, controllable, and more accurate than automatic dispensing, allowing the user to easily operate the washing machine. In addition, the entire dispensing system is less costly and more reliable in operation than the automatic dispensing.

In some embodiments, the visible region 34 may be formed as a transparent region. The visible region 34 may be a part of the liquid mixing box 3 and located at a surface of the liquid mixing box 3 facing towards the user. The liquid mixing box 3 may also be entirely formed as a member of a transparent material. In this case, the liquid mixing box 3 becomes the visible region 34 as a whole, which facilitates a convenient and accurate observation of the liquid mixing cavity 393 by the user. Further, the visible region 34 may be manufactured using a transparent plastic material such as polycarbonate.

Therefore, the dispensing system of the laundry treatment apparatus 10 according to the embodiments of the present disclosure has advantages of allowing the user to observe an actual dispensing amount and determining the dispensing amount as desired, low manufacturing costs, and the like.

Figure 4:
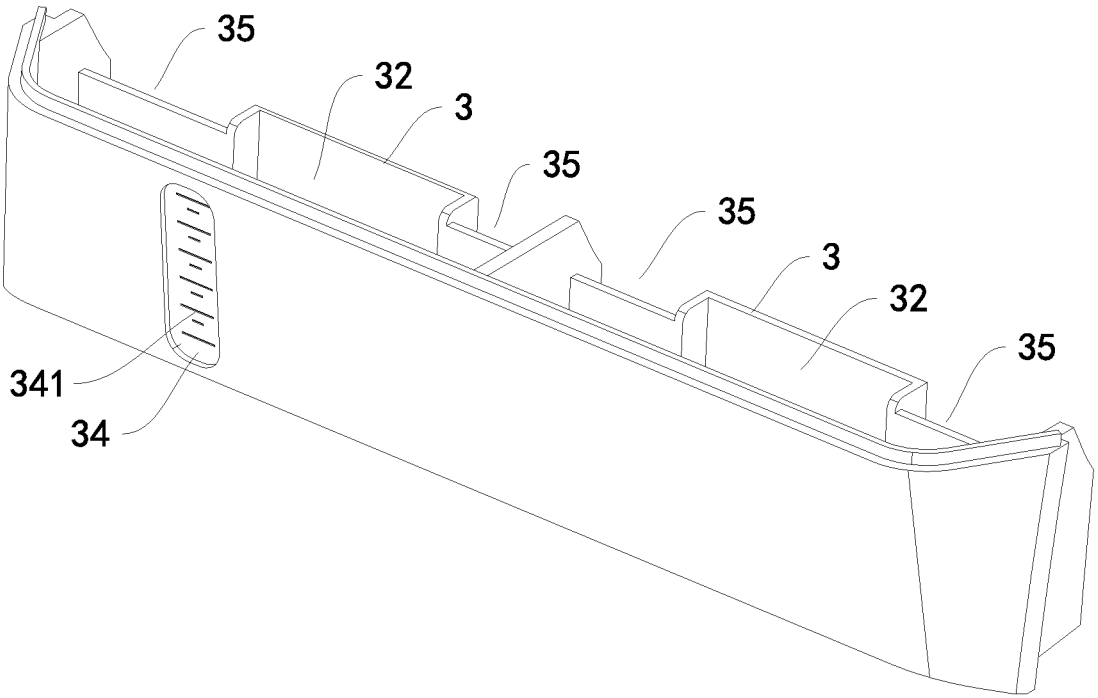
FIG. 4 is a schematic structural view of a liquid mixing box of a laundry treatment apparatus according to some embodiments of the present disclosure.
Figure 5:
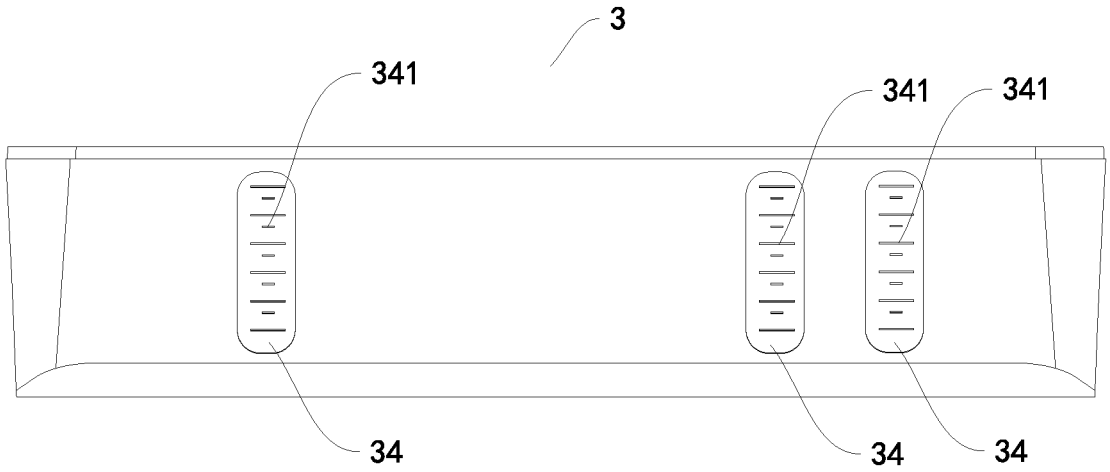
FIG. 5 is a schematic structural view of a liquid mixing box of a laundry treatment apparatus according to some other embodiments of the present disclosure.

In some embodiments, as illustrated in FIG. 4, a scale marker 341 is provided in the visible region 34. In this way, it is convenient for the user to quickly obtain the real dispensing amount of the detergent in the liquid mixing box 3 through observing the scale marker 341, which allows the dispensing of the detergent to be accurately controlled.

In some embodiments, the scale marker 341 includes a scale index marker 342 and an information marker 343. The scale index marker 342 correspond to the information marker 343. In this way, with the scale index marker 342 and the information marker 343, a dispensing condition of the detergent in the liquid mixing cavity 393 can be intuitively displayed to facilitate accurate control of the dispensing amount of the detergent by the user.

Figure 6:
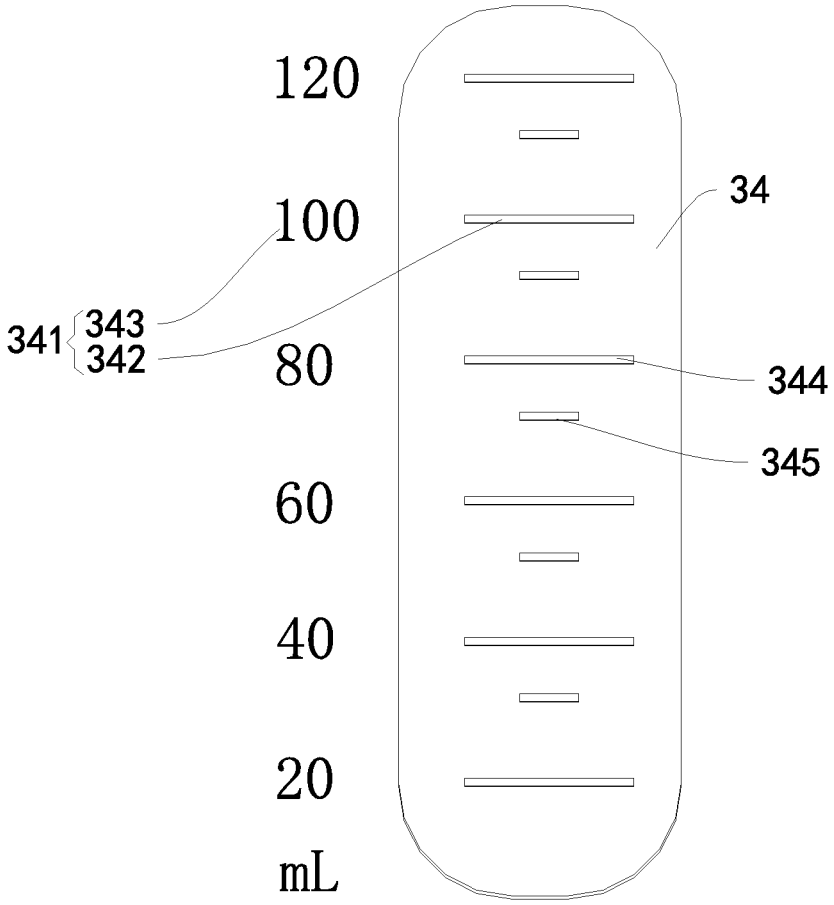
FIG. 6 is a schematic view of a scale marker of a liquid mixing box of a laundry treatment apparatus according to some embodiments of the present disclosure.

In some exemplary embodiments, as illustrated in FIG. 6, the scale marker 341 is a detergent amount marker. Each scale marker represents a predetermined volume of detergent. In this way, the user can select a volume of to-be-dispensed detergent based on a laundry condition, and then control the detergent to be dispensed to the liquid mixing box 3 until the detergent reaches a corresponding scale marker. For example, when determining based on a condition of laundry that detergent of about 40 ml is required to be dispensed, the user may drive the dispensing device to dispense the detergent, and stop driving the dispensing device when it is observed from the visible region that a liquid level of the detergent in the liquid mixing box reaches a scale marker of 40 ml.

In some embodiments, as illustrated in FIG. 6, the scale index marker 342 of the scale marker 341 may be formed as a plurality of long scale indexes and a plurality of short scale indexes arranged at intervals vertically. Each scale index represents one liquid level of the detergent in the liquid mixing cavity 393. The information marker 343 of the scale marker 341 corresponds to a volume of the detergent in the liquid mixing cavity 393. A plurality of information markers 343 may be provided, and the plurality of information markers 343 and the plurality of long scale indexes are in one-to-one correspondence. For example, the long scale index at the bottom corresponds to a volume of detergent of "20 mL." In this way, visual display of a current volume of the detergent in the liquid mixing cavity 393 can be facilitated.

Figure 7:
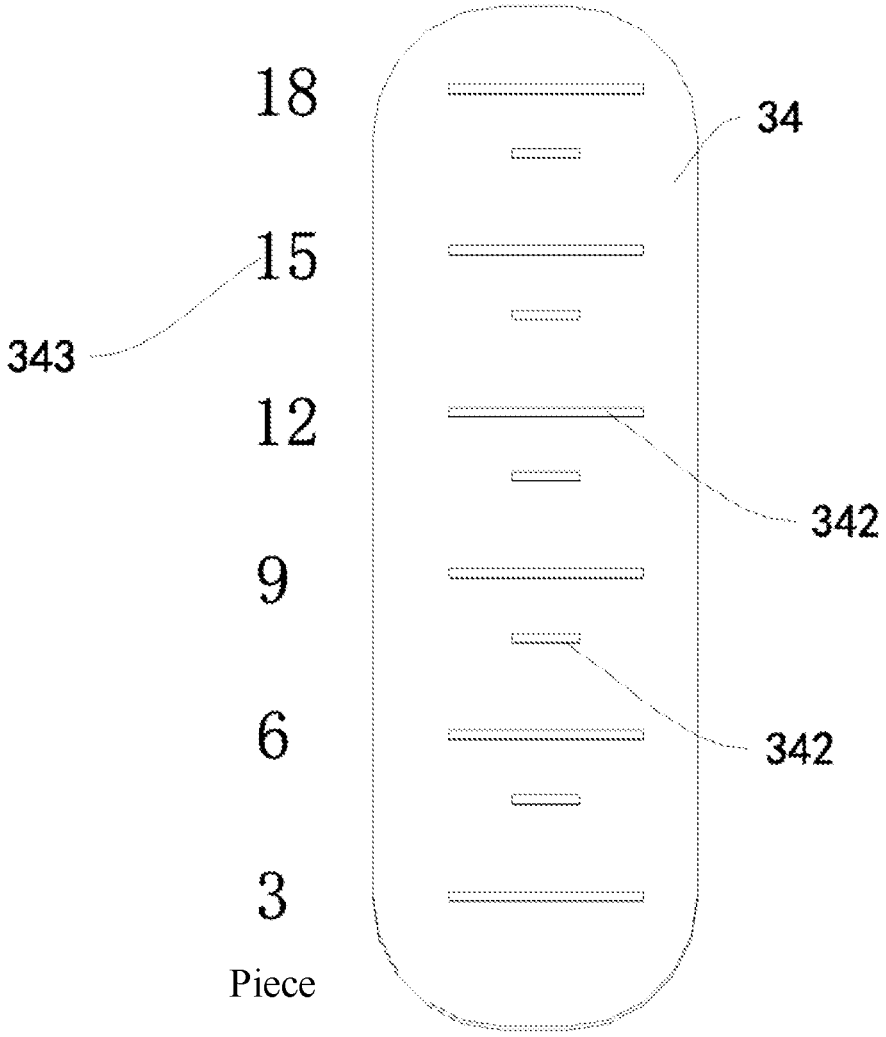
FIG. 7 is a schematic view of a scale marker of a liquid mixing box of a laundry treatment apparatus according to some other embodiments of the present disclosure.
Figure 9:
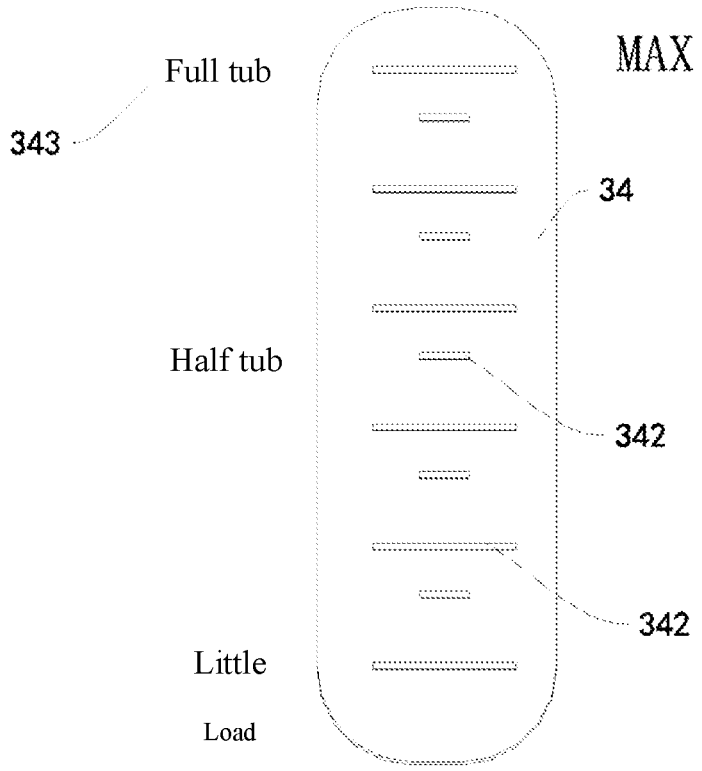
FIG. 9 is a schematic view of a scale marker of a liquid mixing box of a laundry treatment apparatus according to still yet some other embodiments of the present disclosure.
Figure 10:
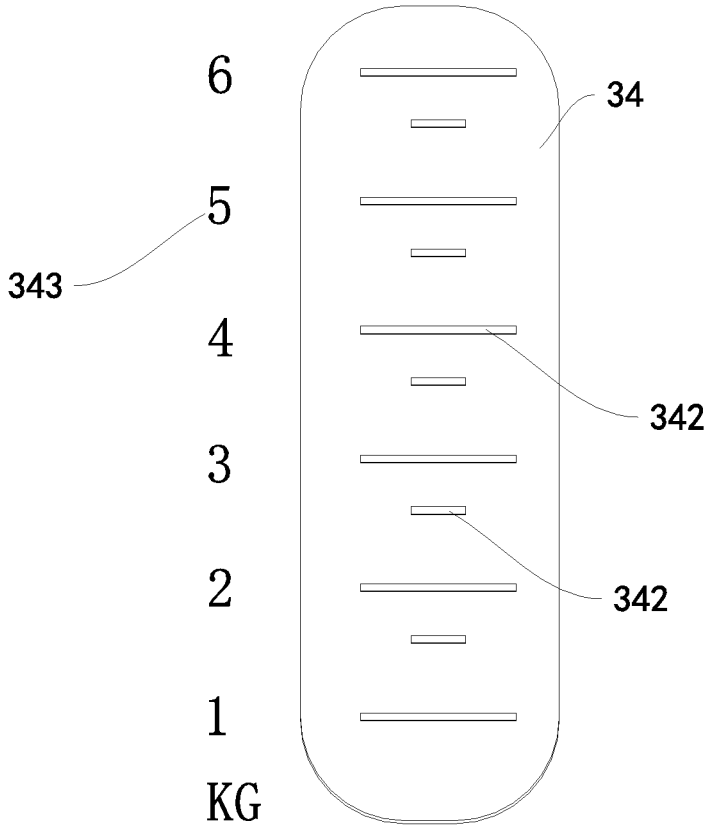
FIG. 10 is a schematic view of a scale marker of a liquid mixing box of a laundry treatment apparatus according to still yet some other embodiments of the present disclosure.

In other embodiments, the scale marker 341 is a laundry metering marker such as an amount of the laundry (as illustrated in FIG. 7), or the scale marker 341 is a volume of the laundry (as illustrated in FIG. 9), or the scale marker 341 is a weight of the laundry (as illustrated in FIG. 10). In this way, the user can select, based on the amount, weight, or volume of the laundry, a liquid level that the detergent should reach, and then dispense the detergent until the detergent reaches the corresponding scale marker 341.

In some embodiments, as illustrated in FIG. 7, the scale index marker 342 of the scale marker 341 may be formed as a plurality of long scale indexes and a plurality of short scale indexes arranged at intervals vertically. Each scale index represents one liquid level of the detergent in the liquid mixing cavity 393. The information marker 343 of the scale marker 341 corresponds to the amount of the laundry. A plurality of information markers 343 may be provided, and the plurality of information markers 343 and the plurality of long scale indexes are in one-to-one correspondence. For example, the long scale index at the bottom corresponds to "three pieces" of laundry. When the amount of the laundry is three, the user controls the dispensing device to dispense the detergent until the detergent reaches the long scale index at the bottom corresponding to a marker of three pieces of laundry in the information marker 343. In this way, visual display of a relation between a liquid level of the detergent in the liquid mixing cavity 393 and the amount of the laundry can be facilitated. Therefore, it is possible for the user to accurately dispense the detergent based on the amount of the laundry.

In other embodiments, as illustrated in FIG. 9, the scale marker 341 is the volume of the laundry. In some embodiments, the scale index marker 342 of the scale marker 341 may be formed into a plurality of long scale indexes and a plurality of short scale indexes arranged at intervals vertically. Each scale index represents one liquid level of the detergent in the liquid mixing cavity 393. The information marker 343 of the scale marker 341 corresponds to a volume of the laundry in the washing tub. A plurality of information markers 343 may be provided, and plurality of information markers 343 and the plurality of scale indexes are in one-to-one correspondence. For example, the short scale index in the middle part corresponds to laundry of a volume of "half tub." In this way, visual display of a relation between the liquid level of the detergent in the liquid mixing cavity 393 and the volume of the laundry can be facilitated. Therefore, it is possible for the user to accurately dispense the detergent based on the volume of the laundry.

In some examples, as illustrated in FIG. 10, the scale index marker 342 of the scale marker 341 may be formed into a plurality of long scale indexes and a plurality of short scale indexes arranged at intervals vertically. Each scale index represents one liquid level of the detergent in the liquid mixing cavity 393. The information marker 343 of the scale marker 341 may also correspond to a weight of the laundry. For example, the long scale index at the bottom corresponds to laundry with a weight of "1 KG." In this way, visual display of a relation between the liquid level of the detergent in the liquid mixing cavity 393 and the weight of the laundry can be facilitated. Therefore, it is possible for the user to accurately dispense the detergent based on the weight of the laundry.

Figure 8:
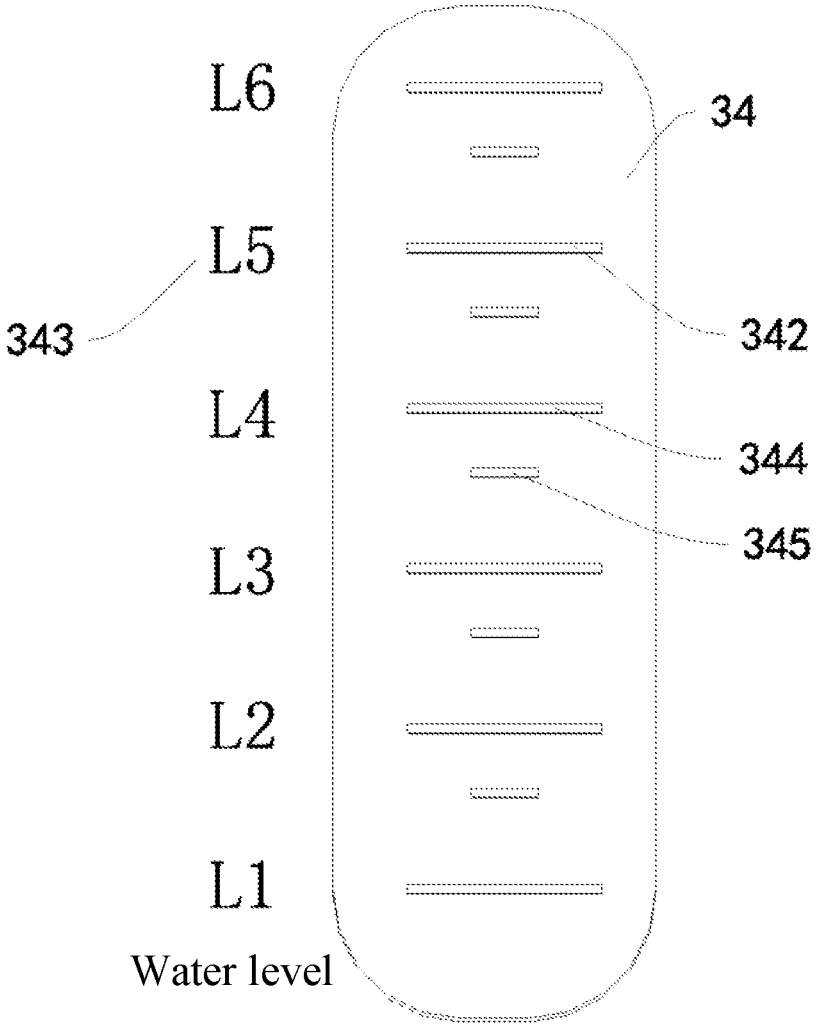
FIG. 8 is a schematic view of a scale marker of a liquid mixing box of a laundry treatment apparatus according to yet some other embodiments of the present disclosure.

In some other embodiments, as illustrated in FIG. 8, the scale marker 341 is an inflow water volume marker or an inflow water level marker of the laundry treatment apparatus. In this way, the user can select, based on an inflow water volume or an inflow water level of the laundry treatment apparatus, a liquid level that the detergent should reach, and then dispense the detergent until the detergent reaches the corresponding scale marker 341.

In some embodiments, as illustrated in FIG. 8, the scale index marker 342 of the scale marker 341 may be formed into a plurality of long scale indexes and a plurality of short scale indexes arranged at intervals vertically. Each scale index represents one liquid level of the detergent in the liquid mixing cavity 393. The information marker 343 corresponds to the inflow water level of the laundry treatment apparatus. A plurality of information markers 343 may be provided, and plurality of information markers 343 and the plurality of long scale indexes are in one-to-one correspondence. For example, the long scale at the bottom corresponds to a water level of "L1." In this way, visual display of a relation between the liquid level of the detergent in the liquid mixing cavity 393 and the inflow water level of the laundry treatment apparatus can be facilitated. Therefore, it is possible for the user to accurately dispense the detergent based on the inflow water level of the laundry treatment apparatus.

In some embodiments, the scale marker 341 is any one of a word, a number, a symbol, and a pattern, or a combination of at least two thereof.

In some embodiments, the scale marker 341 may be formed through engraving, injection molding, printing, spraying, or other methods.

In some embodiments, the scale marker 341 has a plurality of primary scales 344. Each of the plurality of primary scales 344 includes at least one secondary scale 345. As illustrated in FIG. 6, the scale index marker 342 includes a long scale index and a short scale index spaced apart from each other vertically. An interval between two adjacent long scale indexes may represent one primary scale 344 of 10 mL. One short scale index is provided between two adjacent long scale indexes. An interval between the short scale index and the long scale index may represent one secondary scale 345 of 5 mL. In this way, not only the liquid levels of the detergent can be subdivided and displayed, but also the user's intuitive observation and control of the liquid level of the detergent can be facilitated.

Figure 2:
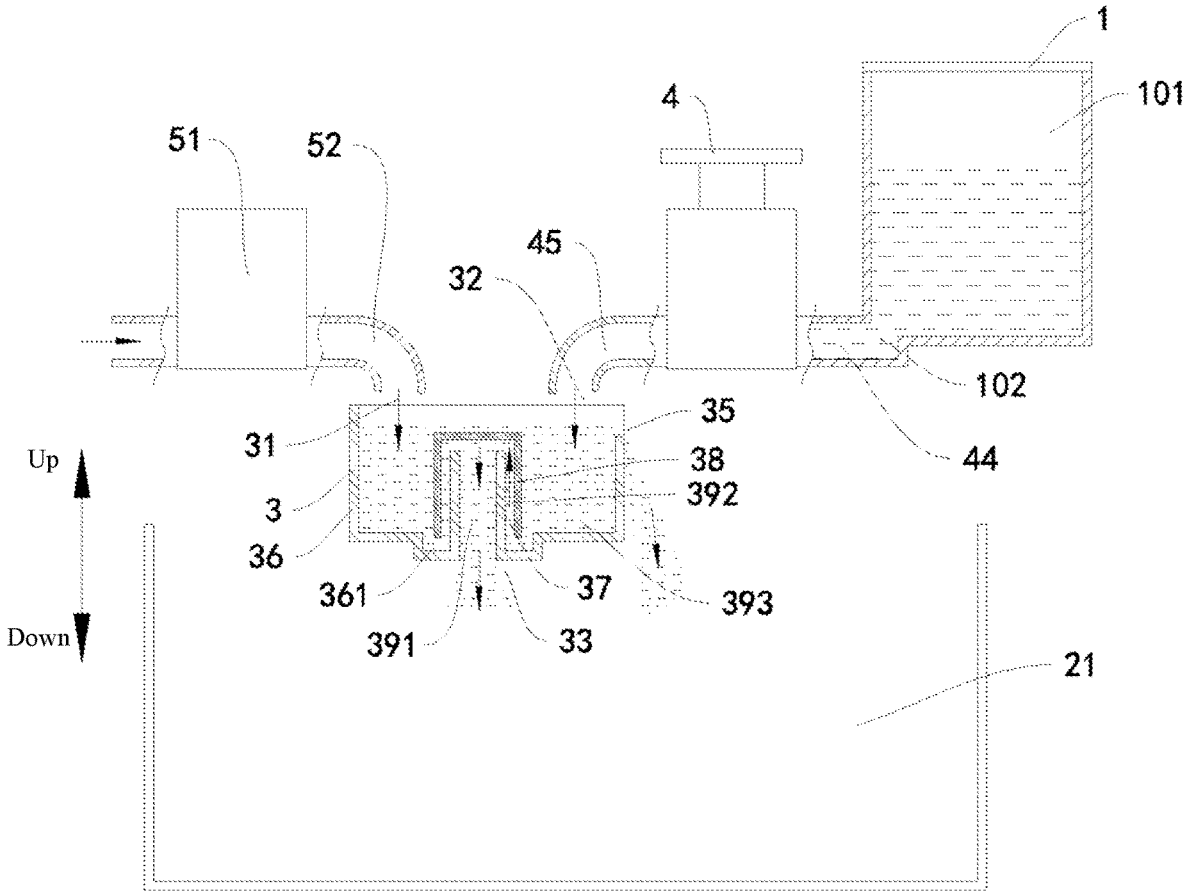
FIG. 2 is a cross-sectional view of a dispensing system of a laundry treatment apparatus according to some embodiments of the present disclosure.

In some embodiments, as illustrated in FIG. 2, the liquid mixing box 3 may have a siphonage passage for communicating the liquid mixing cavity 393 and the mixed liquid outlet 33. After an inflow of water into the liquid mixing box 3 is stopped, a liquid in the liquid mixing box 3 can completely flow out of the liquid mixing box 3 through siphonage and drain the detergent in the liquid mixing box 3. Therefore, it is possible to ensure that the liquid mixing box 3 is in an empty state before next use of the liquid mixing box 3.

In some embodiments, as illustrated in FIG. 2, the liquid mixing box 3 may include a box body 36, a communication pipe 37, and a siphonage cap 38. The liquid mixing cavity 393 is defined in the box body 36. The communication pipe 37 may be connected to the box body 36. A lower end of the communication pipe 37 may be formed into the mixed liquid outlet 33 (an up-down direction is as illustrated in FIG. 1 and FIG. 2). An upper end of the communication pipe 37 is located in the liquid mixing cavity 393. The siphonage cap 38 is disposed in the liquid mixing cavity 393. The siphonage cap 38 is arranged around the communication pipe 37. Further, the siphonage cap 38 is spaced apart from the communication pipe 37. For example, the siphonage cap 38 covers an outer side of the communication pipe 37 from above. Further, the siphonage passage may include a first channel 391 and a second channel 392 in communication with the first channel 391. The first channel 391 is defined in the communication pipe 37. The second channel 392 may be defined between an outer wall surface of the communication pipe 37 and an inner wall surface of the siphonage cap 38. In this way, after the inflow of the water into the liquid mixing box 3 is stopped, the liquid in the liquid mixing box 3 can completely flow out of liquid mixing box 3 through the siphonage structure as described above. That is, the detergent in the liquid mixing box 3 can be completely drained, thereby ensuring that the liquid mixing box 3 is in the empty state before the next use of the liquid mixing box 3.

Further, the box body 36 and the communication pipe 37 are integrally formed. The upper end of the communication pipe 37 is located at an upper part of the liquid mixing cavity 393 in the liquid mixing cavity 393. A shape of the siphonage cap 38 is adapted to the communication pipe 37. The siphonage cap 38 has an open end and a closed end. The siphonage cap 38 removably covers the outer side of the communication pipe 37. The communication pipe 37 and the siphonage cap 38 each are a round tube and are arranged concentrically. In this way, it is possible to ensure a constant distance between an inner peripheral wall of the siphonage cap 38 and an outer peripheral wall of the communication pipe 37.

In some embodiments, as illustrated in FIG. 2, a bottom wall of the box body 36 may have an accommodation recess 361 recessed downwards. The lower end of the communication pipe 37 is connected to a bottom wall of the accommodation recess 361, and the upper end of the communication pipe 37 is located at the upper part of the liquid mixing cavity 393 in the liquid mixing cavity 393. In this way, an increase in the dispensing amount of the detergent dispensed into the liquid mixing box 3 can be facilitated, and a smooth discharge of a mixed liquid out of the liquid mixing cavity 393 can be further facilitated.

In some embodiments, as illustrated in FIG. 2, the liquid mixing box 3 has an overflow opening 35. The overflow opening 35 is formed to be in communication with a laundry treatment cavity 21 and the liquid mixing cavity 393 of the washing machine. In this way, during the water inflow, tap water flows into the liquid mixing box 3, which causes a liquid level in the liquid mixing box 3 to rise continuously. When the liquid level in the liquid mixing box 3 exceeds a height of the siphonage passage, the liquid flows out of the siphonage passage, forming siphonage, and an excess liquid and a liquid which does not flow from the siphonage passage timely will flow through the overflow opening 35 and finally flow into the washing tub. In this way, not only reliable mixing of the detergent and clean water in the liquid mixing box 3 can be facilitated, but also damages to the liquid mixing box 3 caused by an impact of a water flow can be avoided.

In some embodiments, as illustrated in FIG. 2, the overflow opening 35 may be formed at an upper part of a side wall of the liquid mixing box 3. An upper end of the liquid mixing box 3 is open. The overflow opening 35 may be formed at an upper edge of a side wall of the liquid storage box 1. A height of the overflow opening 35 is equal to or higher than the height of the siphonage passage. In this way, not only the liquid mixing box 3 can be ensured to be filled with the inflow water to facilitate sufficient mixing of the inflow water with the detergent, but also the excess inflow water can be discharged timely to avoid the damages to the liquid mixing box 3 caused by the impact of the water flow.

In some embodiments, as illustrated in FIG. 4, the upper end of the liquid mixing box 3 may be open to form the water inlet 31 and the first liquid inlet 32. In some embodiments, the water inlet 31 and the first liquid inlet 32 are one opening, which facilitates cooperation of the liquid storage box 1 with a water inlet device and the dispensing device 4. The first liquid outlet 102 is located at a bottom of the liquid storage box 1. In this way, it is possible to drain the detergent in the liquid storage box 1, thereby avoiding waste caused when the detergent is accumulated in the liquid storage box 1 for a long time.

In the present disclosure, a plurality of liquid storage boxes 1 may be provided, and a plurality of liquid mixing boxes 3 may be provided. The plurality of liquid storage boxes 1 and the plurality of liquid mixing boxes 3 are in one-to-one correspondence. In this way, detergents of different types can be placed separately in the plurality of liquid storage boxes 1 to facilitate separate dispensing of the detergents of different types into the laundry treatment cavity 21.

In some embodiments, the liquid storage box 1 may include a first liquid storage box and a second liquid storage box. The first liquid storage box is configured to store a laundry detergent, and the second liquid storage box is configured to store a fabric softener. The liquid mixing box 3 may include a first liquid mixing box and a second liquid mixing box arranged side by side and integrally formed. The first liquid mixing box is connected to the first liquid storage box. The second liquid mixing box is connected to the second liquid storage box.

In some examples of the present disclosure, one or more groups of liquid storage boxes 1 are embedded or semi-embedded at an operation console of the laundry treatment apparatus. The liquid storage box 1 is connected to the dispensing device 4. When an appropriate amount of the detergent in the liquid storage box 1 is dispensed into the liquid mixing box 3 by the user as desired, a water inlet valve 51 of the water inlet device is opened, and thus the tap water flows into the liquid mixing box 3 through a water inlet pipe 52 to mix with the detergent. The diluted and mixed detergent water finally flows into the washing tub. The liquid mixing box 3 has the siphonage passage. When the liquid level in the liquid mixing box 3 rises continuously and excesses the height of the siphonage passage, the mixed liquid will flow out of the siphonage passage. The excess liquid in the liquid mixing box 3 and the liquid that does not flow out of the siphonage passage timely will flow through the overflow opening 35 and finally flow into the washing tub.

In some embodiments of the present disclosure, the dispensing device 4 includes a drive assembly and a dispensing assembly. The drive assembly includes a driver 463 in a transmission connection with the dispensing assembly. The driver 463 is configured to move to drive the dispensing assembly to dispense the detergent. In this way, the dispensing amount of the detergent dispensed by the dispensing assembly can be controlled by the driver 463. That is, a movement of the dispensing assembly can be controlled by the driver 463. In this way, the detergent can be delivered by the dispensing assembly from the liquid storage cavity 101 to the liquid mixing cavity 101, realizing smooth delivery and accurate dispensing of the detergent.

Figure 3:
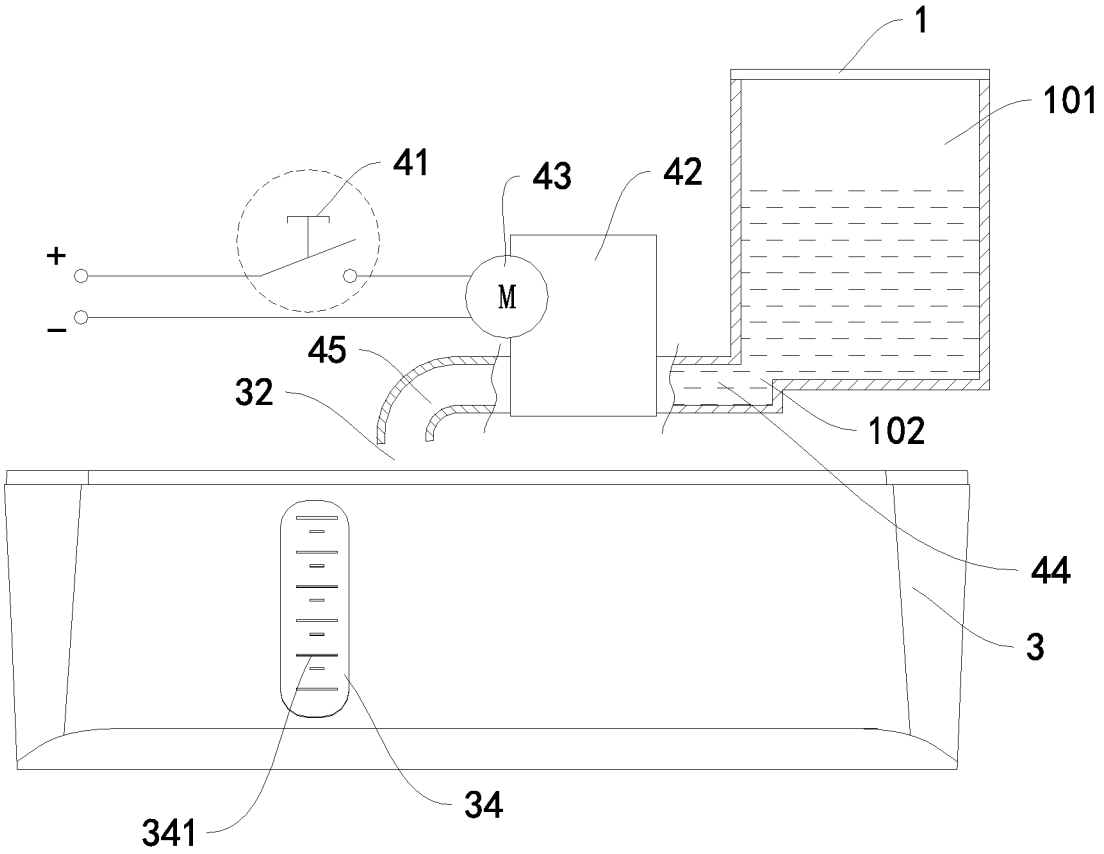
FIG. 3 is a cross-sectional view of a dispensing system of a laundry treatment apparatus according to some other embodiments of the present disclosure.

In some embodiments, as illustrated in FIG. 2 and FIG. 3, the laundry treatment apparatus 10 further includes a first liquid inlet pipe 44 and a second liquid inlet pipe 45. The first liquid inlet pipe 44 is connected to the first liquid outlet 102 and the dispensing device 4. The second liquid inlet pipe 45 is in communication with the dispensing device 4 and the liquid mixing cavity 393. A height of the first liquid outlet 102 is higher than a height of the first liquid inlet 32. The driver 463 is disposed at the dispensing device 4. When the driver 463 is operated by the user, the detergent can flow from the first liquid outlet 102 into the first liquid inlet pipe 44, flow through the dispensing device 4, and then be discharged from the second liquid inlet pipe 45 into the liquid mixing cavity 393.

In some other embodiments, a check valve may be provided in the first liquid inlet pipe 44. The check valve is configured to allow for only unidirectional flowing of the liquid in the liquid storage cavity 101 into the first liquid inlet pipe 44. In this way, it is possible to prevent the detergent or the liquid from flowing back into the liquid storage box 1, thereby avoiding contamination of the liquid storage cavity 101.

In the dispensing system of the present disclosure, the dispensing assembly includes a housing, and the driver 463 is located outside the housing, or the driver 463 is formed as a part of the housing. In this way, a movement space of the driver 463 is free from a limitation of a size of the housing, which is conducive to extending a movement travel of the driver 463, thereby increasing a single dispensing amount of the dispensing device 4.

In some embodiments of the present disclosure, the dispensing assembly includes a dispensing pump 46. The dispensing pump 46 includes a pump case 461 and a pump body 462. The pump case 461 is formed as a casing. The pump body 462 is disposed in the pump case 461. The driver 463 is in a transmission connection with the pump body 462. The driver 463 may be disposed outside the pump case 461. The driver 463 may be moved to drive the pump body 462 to move, allowing the detergent to be dispensed.

In some embodiments of the present disclosure, the pump body 462 may be movably disposed in the pump case 461. In this case, as an example, the dispensing pump 46 may be a piston pump. The driver 463 may be moved to drive the pump body 462 to move, allowing the detergent to be dispensed.

In some other embodiments of the present disclosure, the pump body 462 may be rotatably disposed in the pump case 461. In this case, as an example, the dispensing pump 46 may be a gear pump, an impeller pump, or a screw pump. The driver 463 may be moved to drive the pump body 462 to rotate, allowing the detergent to be dispensed. By rotatably arranging the pump body 462 in the pump case 461, it is possible to form a liquid suction region and a liquid discharge region in different regions in the pump case 461, respectively. The liquid suction region corresponds to a first pump liquid inlet. The liquid discharge region corresponds to a first pump liquid outlet. For example, the driver 463 may be manually driven by the user to rotate to drive the pump body 462 to rotate, thereby realizing the semi-automatic dispensing of the dispensing device 4. That is, a quantitative amount of detergent can be dispensed manually.

It should be understood that, in the embodiments in which the pump body 462 is rotatably disposed in the pump case 461, in an initial state of the dispensing device 4 (no detergent is present in the liquid discharge region), when the driver 463 is rotated to drive the pump body 462 to rotate, a negative pressure may be generated in the liquid suction region and a positive pressure may be generated in the liquid discharge region. The detergent at the first pump liquid inlet flows towards the liquid discharge region under an effect of a pressure difference. In this process, liquid suction at the first pump liquid inlet of the dispensing pump 46 and liquid discharge at the first pump liquid outlet of the dispensing pump 46 are unsynchronized, until the detergent can be discharged from the first pump liquid outlet. Subsequently, i.e., when the dispensing device 4 is in normal operation, the liquid suction at the first pump liquid inlet of the dispensing pump 46 and the liquid discharge at the first pump liquid outlet of the dispensing pump 46 are synchronized in time when the driver 463 is rotated to dispense the detergent.

With the dispensing device 4 according to this embodiment, quantitative control of the dispensing amount of the detergent can be realized by controlling the movement of the driver 463. In addition, by rotatably arranging the pump body 462 in the pump case 461, the liquid suction region and the liquid discharge region formed in the pump case through a rotation of the pump body 462 of the dispensing pump 46 during operation of the dispensing device 4 are located at different regions. When a first pump liquid outlet of the dispensing device 4 starts discharging the liquid, the liquid suction at the first pump liquid inlet of the dispensing pump 46 and the liquid discharge at the first pump liquid outlet of the dispensing pump 46 are synchronized, and thus the dispensing amount of the dispensing pump 46 is free from a limitation of a volume of the dispensing pump 46. Therefore, it is conducive to increasing a single dispensing amount of the detergent by the dispensing device 4. Therefore, in a case of a constant volume of the dispensing device 4, the single dispensing amount of the dispensing device 4 can be increased and an accuracy of the single dispensing can be ensured, which is conducive to reducing the number of times of dispensing and ensures that accuracy requirements are satisfied. Therefore, it is applicable to laundry treatment apparatuses 10 of large-capacity such as a washing machine for the dispensing requirements of the detergent, thereby improving use experience of the user.

In some embodiments of the present disclosure, the driver 463 is an electrically operated driver, which can provide satisfying experience for the user. The electrically operated driver is configured to drive the detergent to flow into the liquid mixing box 3 continuously, and then stop driving the detergent when the detergent reaches a liquid level scale of a required dispensing amount, thereby realizing fast, accurate, and controllable dispensing.

In some embodiments, the drive assembly further includes a controller 41 connected to the electrically operated driver. The controller 41 is configured to control a connection or a disconnection between the electrically operated driver and a power supply. In this way, when the controller 41 is triggered, the electrically operated driver is operated by the user to communicate the liquid storage cavity 101 and the liquid mixing cavity 393 and to drive the detergent in the liquid storage cavity 101 to be delivered into the liquid mixing cavity 393. When a required amount of the detergent is delivered into the liquid mixing cavity 393, the electrically operated driver is operated by the user to control the dispensing device 4 to stop operation, and then the controller 41 is disconnected to cut off an electric connection between the electrically operated driver and the power supply, preventing the electrically operated driver from being in operation due to an accidental triggering of the user. Thus, with the controller 41, use safety and reliability of the dispensing device 4 can be enhanced.

In some other embodiments, the controller 41 may be a mechanical switch, a touch switch, an inductive switch, and various other switches for controlling the power supply to be switched on or switched off.

In some other embodiments of the present disclosure, the driver 463 is a manually operated driver. In this way, the detergent can be dispensed by the user manually without a connection to the power supply, and the dispensing device 4 has a simple structure and low costs.

In some embodiments, the drive assembly further includes a transmission assembly located between the driver 463 and the dispensing assembly. The transmission assembly is fixedly arranged relative to the dispensing assembly and is in a transmission connection with the driver 463. In this way, control on the dispensing operations of the dispensing assembly by the driver 463 can be easily implemented by means of a force transferring of the transmission assembly.

In some embodiments, the transmission assembly includes a first transmission member 481, and the driver 463 includes a second transmission member 4631. The first transmission member 481 is engaged with or abuts against the second transmission member 4631. In this way, reliability and an accuracy of force transferring can be ensured to avoid phenomena such as an operation delay.

In some examples, as illustrated in FIG. 11 to FIG. 15, the first transmission member 481 is a gear, and the second transmission member 4631 is a rack disposed at the driver 463. The rack extends along a movement trajectory of the driver 463. In this way, through manually driving the driver 463 to move and through an engagement between the first transmission member 481 and the second transmission member 4631, a force can be reliably transferred to the dispensing assembly to dispense the detergent, which facilitates control on the operation of the dispensing assembly.

In other examples, as illustrated in FIG. 16 to FIG. 19, the first transmission member 481 is a ratchet, and the second transmission member 4631 is a pawl. In this way, the driver 463 can be manually driven by the user to move, and the force can be reliably transferred through an engagement or abutment between the first transmission member 481 and the second transmission member 4631, to the dispensing assembly to dispense the detergent. Therefore, control on the operations of the dispensing assembly can be facilitated. In addition, by constructing the first transmission member 481 as the ratchet and the second transmission member 4631 as the pawl, a unidirectional intermittent movement of the dispensing assembly can be realized by utilizing a unidirectional movement characteristic of a cooperation between the ratchet and the pawl, which facilitates precise control on the dispensing amount of the detergent.

In some embodiments of the present disclosure, as illustrated in FIG. 16 to FIG. 19, the dispensing assembly includes a compartmentalizer 472. The compartmentalizer 472 is configured to dispense the detergent. The compartmentalizer 472 has a plurality of compartments 4721. A communication opening 4722 is formed at a peripheral side wall of each compartment 4721. The compartment 4721 is in communication with the first liquid outlet 102 at the liquid storage box 1 through one of the communication openings 4722 corresponding to the compartment 4721. In this way, each compartment 4721 is configured to receive the detergent in the liquid storage cavity 101 and then deliver the detergent to the liquid mixing box 3, realizing control on the dispensing amount of the detergent.

In some embodiments, as illustrated in FIG. 16 to FIG. 19, the dispensing device 4 includes a housing 471, the compartmentalizer 472, and the driver 463. The compartmentalizer 472 has the plurality of compartments 4721. The driver 463 is connected to the compartmentalizer 472. The compartmentalizer 472 is driven by the driver 463 to dispense the detergent. The housing 471 has a second liquid inlet and a second liquid outlet. It should be understood that the detergent may be held in the housing 471. With the second liquid outlet formed at the housing 471, the detergent can be discharged through the second liquid outlet at the housing. A holding cavity is defined by the housing 471. The housing 471 has the second liquid inlet and the second liquid outlet that are in communication with an accommodation cavity. The present disclosure is not limited in this regard. In another example of the present disclosure, the detergent may also be loaded in another container outside the housing 471, and may be delivered to the second liquid inlet through a connection pipe.

The compartmentalizer 472 has a plurality of liquid outlet positions and is switchable between the plurality of liquid outlet positions. The liquid outlet positions have a same quantity as that of the compartments 4721 and are in one-to-one correspondence with the compartments 4721. When the compartmentalizer 472 is at the liquid outlet position, the corresponding compartment 4721 is in communication with the second liquid outlet. The compartmentalizer 472 is driven by the driver 463 to dispense the detergent. When the detergent needs to be dispensed by the user, a force may be manually exerted to the driver 463 by the user, to allow the driver 463 to be moved by the exerted external force and to drive the compartmentalizer 472 to move synchronously, thereby realizing the dispensing of the detergent.

In the dispensing system of the present disclosure, the drive assembly further includes an elastic restoring member 490. The elastic restoring member 490 is connected to the driver 463, or the elastic restoring member 490 is formed by at least part of the driver 463. In this way, automatic restoring of the driver 463 can be realized to facilitate next operation of the user on the driver 463.

Figure 12:
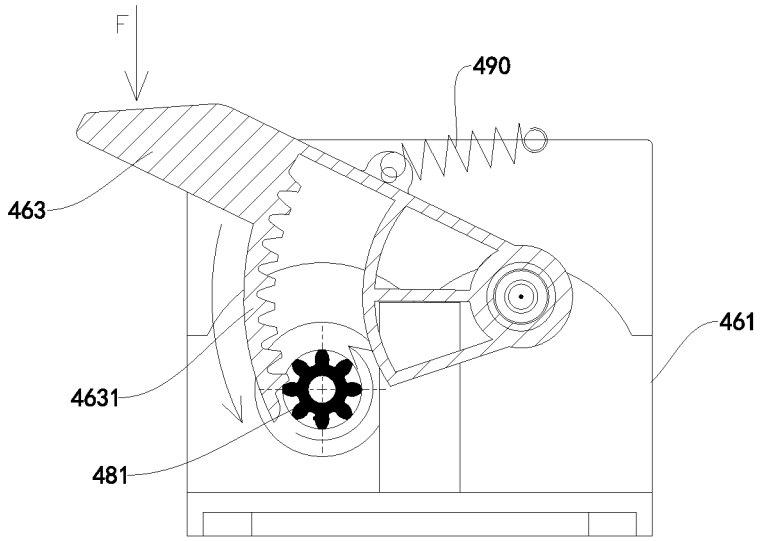
FIG. 12 is a cross-sectional view of a dispensing device of a laundry treatment apparatus according to some embodiments of the present disclosure.
Figure 15:
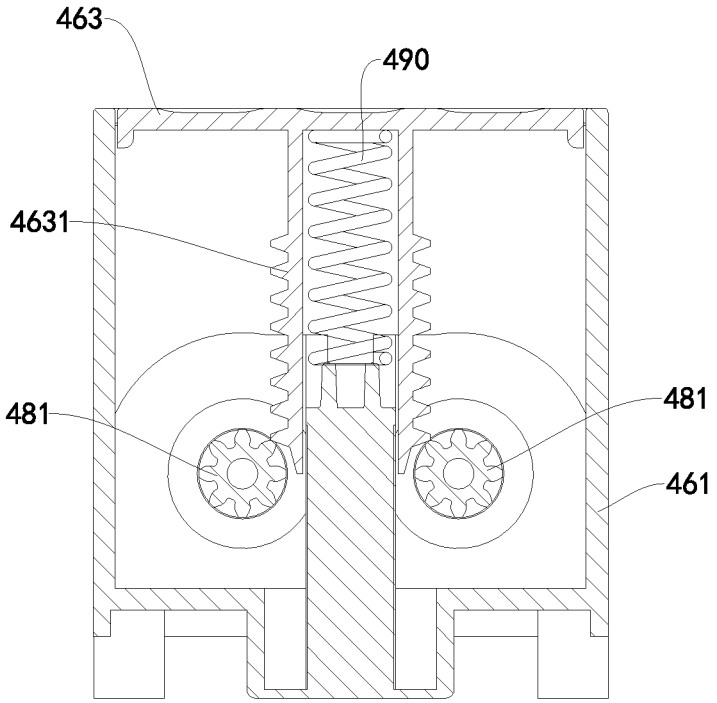
FIG. 15 is a cross-sectional view of a dispensing device of a laundry treatment apparatus according to some other embodiments of the present disclosure.
Figure 16:
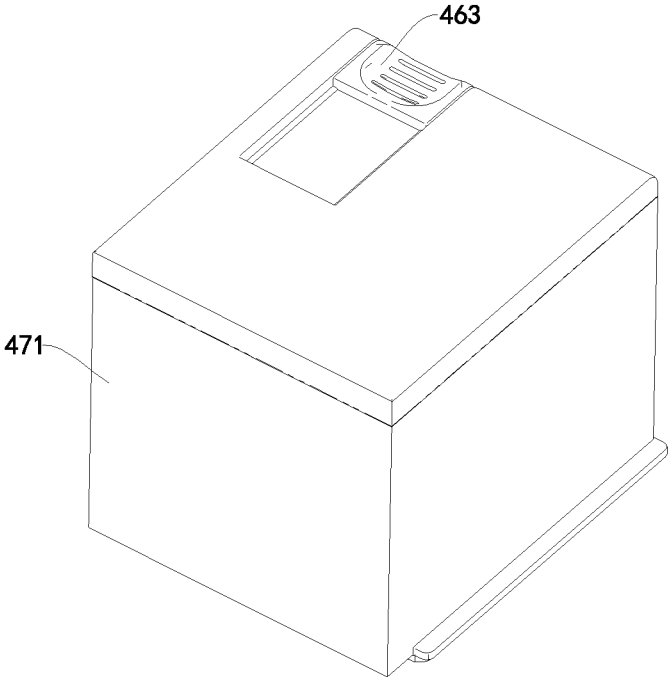
FIG. 16 is a schematic structural view of a dispensing device of a laundry treatment apparatus according to yet some other embodiments of the present disclosure.
Figure 17:
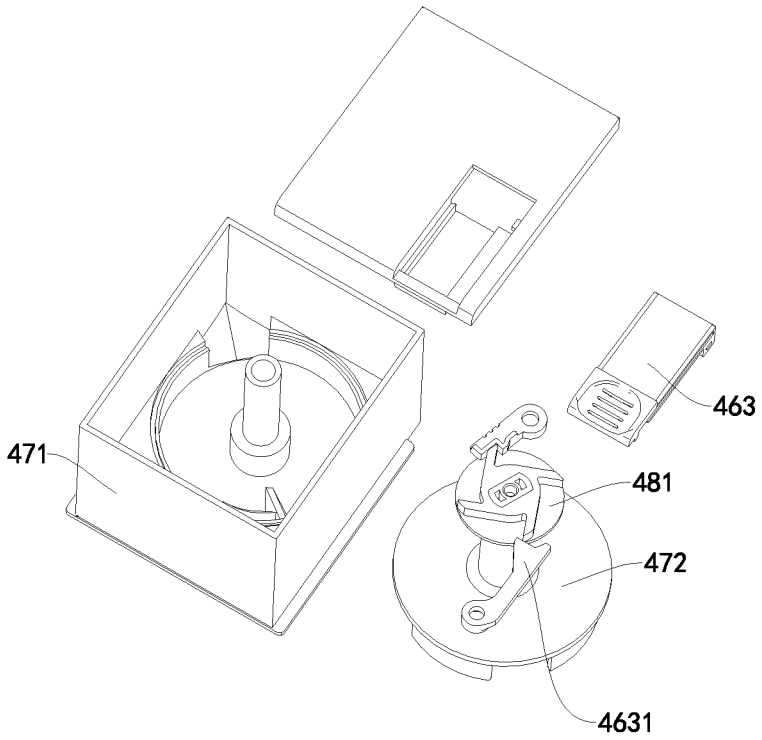
FIG. 17 is an exploded view of a dispensing device of a laundry treatment apparatus according to yet some other embodiments of the present disclosure.
Figure 18:
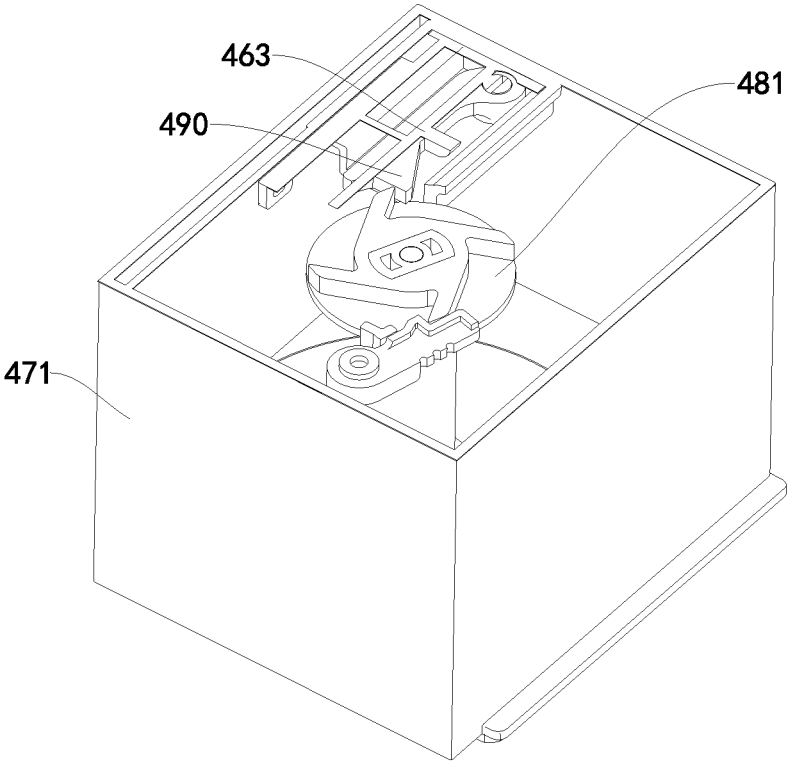
FIG. 18 is a schematic partial structural view of a dispensing device of a laundry treatment apparatus according to yet some other embodiments of the present disclosure.
Figure 19:
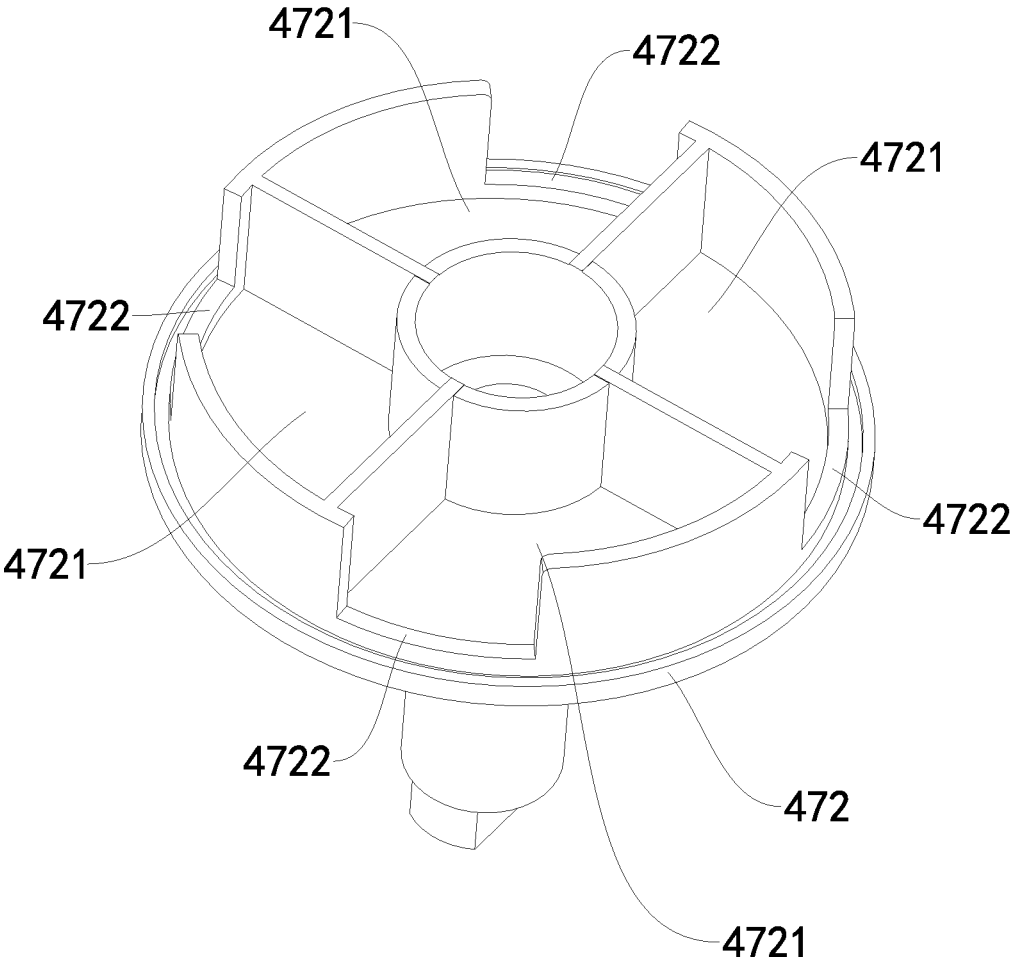
FIG. 19 is a schematic structural view of a compartmentalizer of a dispensing device of a laundry treatment apparatus according to yet some other embodiments of the present disclosure.

In some examples, as illustrated in FIG. 12 and FIG. 15, the elastic restoring member 490 is formed as a spring and is connected to the driver 463. In other examples, as illustrated in FIG. 18, the elastic restoring member 490 is formed by a part of the driver 463.

In the dispensing system of the present disclosure, the driver 463 has a straight movement trajectory, a curved movement trajectory, or a combination thereof. In this way, the movement trajectory of the driver 463 can be determined as desired to facilitate the user's operation on the driver 463, thereby improving user's operation comfort and convenience.

Figure 11:
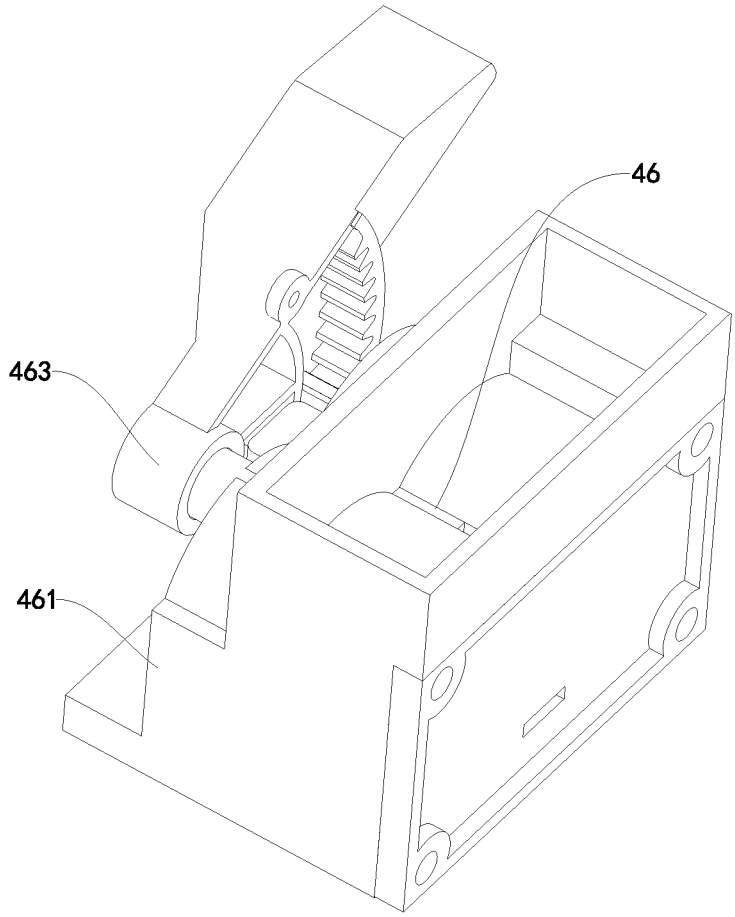
FIG. 11 is a schematic structural view of a dispensing device of a laundry treatment apparatus according to some embodiments of the present disclosure.

In some examples of the present disclosure, as illustrated in FIG. 11 and FIG. 12, the driver 463 has a curved movement trajectory. In some embodiments, the driver 463 has an arc-shaped movement trajectory. In this embodiment, the dispensing assembly includes the above-mentioned dispensing pump 46. The dispensing pump 46 includes the pump case 461 and the pump body 462. The pump body 462 is rotatably disposed in the pump case 461. The driver 463 is rotatably disposed outside the pump case 461. The drive assembly includes the transmission assembly located between the driver 463 and the dispensing assembly. The transmission assembly is in the transmission connection with the driver 463. The transmission assembly includes the first transmission member 481 and the second transmission member 4631 engaged with each other. The first transmission member 481 is the gear. The first transmission member 481 is connected to and fixed relative to the pump body 462. The second transmission member 4631 is an arc-shaped rack disposed at the driver 463. The arc-shaped rack extends along the movement trajectory of the driver 463.

In this embodiment, the driver 463 may be manually driven by the user to rotate from one position to another position. During a rotation of the driver 463, the engagement between the first transmission member 481 and the second transmission member 4631 can allow the external force exerted by the user to be reliably transferred to the pump body 462 to rotate the pump body 462, and thus the detergent can be dispensed. The quantitative control on the dispensing amount of the detergent can be realized by controlling a rotation angle of the driver 463, which facilitates the control on the single dispensing amount of the dispensing device 4. Therefore, the dispensing device 4 has a simple structure and is easily operated. After the dispensing of the detergent is completed, the driver 463 may be returned to an initial position by means of the above-mentioned elastic restoring member 490.

Figure 13:
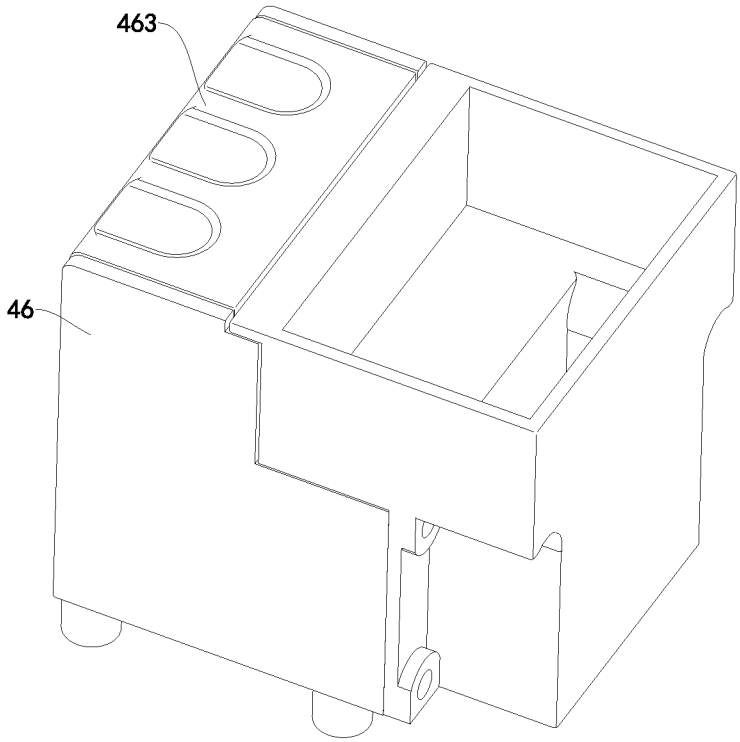
FIG. 13 is a schematic structural view of a dispensing device of a laundry treatment apparatus according to some other embodiments of the present disclosure.
Figure 14:
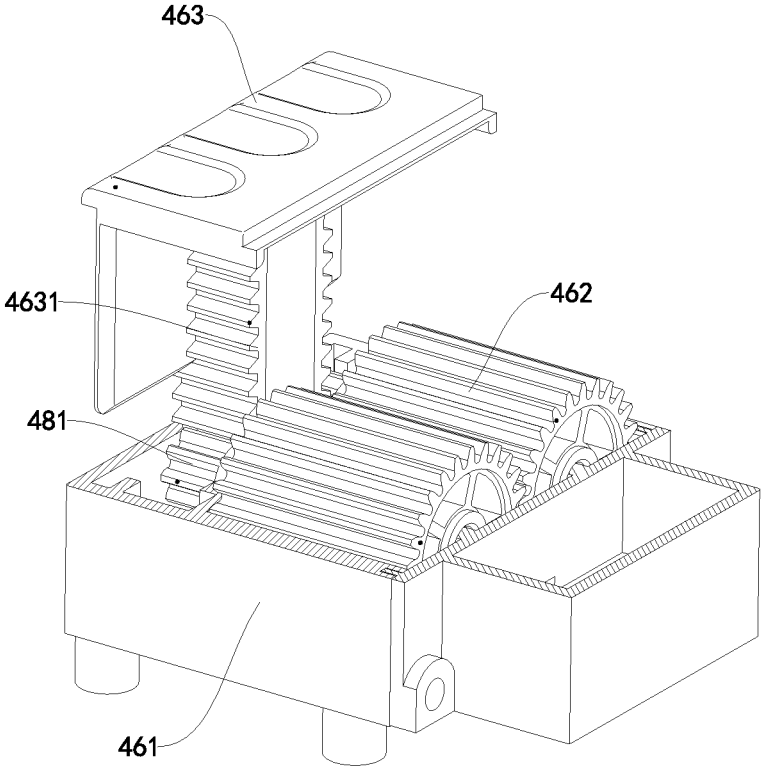
FIG. 14 is a partial cross-sectional view of a dispensing device of a laundry treatment apparatus according to some other embodiments of the present disclosure.

In some other exemplary examples of the present disclosure, as illustrated in FIG. 13 to FIG. 15, the driver 463 has a straight movement trajectory. In some embodiments, the driver 463 has a straight movement trajectory extending in an up-down direction. In this embodiment, the dispensing assembly includes the above-mentioned dispensing pump 46. The dispensing pump 46 includes the pump case 461 and the pump body 462. The pump body 462 is rotatably disposed in the pump case 461. The driver 463 is disposed in the pump case and is movable in the up-down direction. The drive assembly includes the transmission assembly located between the driver 463 and the dispensing assembly. The transmission assembly is in the transmission connection with the driver 463. The transmission assembly includes the first transmission member 481 and the second transmission member 481 engaged with each other. The first transmission member 481 is the gear. The first transmission member 481 is connected to and fixed relative to the pump body 462. The second transmission member 4631 is a linear rack disposed at the driver 463. The linear rack extends in the up-down direction.

In this embodiment, the driver 463 may be manually driven by the user to move from one position to another position vertically. During a movement of the driver 463, the engagement between the first transmission member 481 and the second transmission member 4631 can allow the external force exerted by the user to be reliably transferred to the pump body 462 to rotate the pump body 462, and thus the detergent can be dispensed. The quantitative control on the dispensing amount of the detergent can be realized by controlling a movement distance of the driver 463 in the up-down direction, which facilitates the control on the single dispensing amount of the dispensing device 4. Therefore, the dispensing device 4 has a simple structure and is easily operated. After the dispensing of the detergent is completed, the driver 463 may be returned to the initial position by means of the above-mentioned elastic restoring member 490.

In some other examples of the present disclosure, as illustrated in FIG. 16 to FIG. 19, the driver 463 has a straight movement trajectory extending horizontally. In this embodiment, the dispensing assembly includes the device housing 471 and the above-mentioned compartmentalizer 472. The driver 463 may be disposed at the device housing 471 and is movable horizontally. The compartmentalizer 472 is rotatably disposed at the device housing 471. The compartmentalizer 472 has a plurality of compartments 4721. The drive assembly includes the transmission assembly located between the driver 463 and the dispensing assembly. The transmission assembly is in the transmission connection with the driver 463. The transmission assembly includes the first transmission member 481 and the second transmission member 481 engaged with or abuts against each other. The first transmission member 481 is the ratchet. The first transmission member 481 is connected to and fixed relative to the compartmentalizer 472. The second transmission member 4631 is the pawl disposed at the driver 463.

In this embodiment, the driver 463 may be manually driven by the user to move horizontally from one position to another position. During the movement of the driver 463, the engagement or abutment between the first transmission member 481 and the second transmission member 4631 can allow the external force exerted by the user to be reliably transferred to the compartmentalizer 472 to rotate the compartmentalizer 472, and thus the detergent can be dispensed. The dispensing device can realize quantitative and accurate dispensing of the detergent. In addition, the dispensing device has a simple structure and is easily operated. After the dispensing of the detergent is completed, the driver 463 may be returned to the initial position by the above-mentioned elastic restoring member 490.

A laundry treatment apparatus 10 according to the embodiments of the present disclosure will be described below. For example, the laundry treatment apparatus 10 may be a cleaning device such as a top load washing machine or an all-in-one drying-washing machine. The laundry treatment apparatus 10 according to the embodiments of the present disclosure may include a machine body 2 and a dispensing system. The machine body 2 internally has a laundry treatment cavity 21. The laundry treatment cavity 21 has an upper end having an opening for picking and placing. A liquid mixing box 3 of the dispensing system is disposed in the laundry treatment cavity 21. A mixed liquid outlet 33 is in communication with the laundry treatment cavity 21. The dispensing system is the dispensing system of the laundry treatment apparatus 10 according to the above embodiments of the present disclosure.

The dispensing system may also be applied in a cleaning device such as a dishwasher.

In some embodiments, the liquid storage box 1 is disposed at an outer side of the machine body 2 and removably connected to the machine body 2. For example, the liquid storage box 1 may be lifted upwards by the user for a removal and moved downwards by the user for mounting. As a result, it is possible not only to realize dismounting and mounting of the liquid storage box 1, but also to allow the user to remove the liquid storage box 1 for cleaning within a period of time, thereby avoiding situations where the liquid stored in the liquid storage box 1 dries up, blocks the channel, and even causes damages to the dispensing system when the laundry treatment apparatus 10 is not used for a long time. In a case where changes are made among detergents of different varieties by the user, the liquid storage box 1 can be easily cleaned to avoid a compromise in the cleaning performance due to a mixture of different detergents.

According to an exemplary example of the present disclosure, the laundry treatment apparatus may be a top load washing machine, and the liquid storage box 1 is a device for storing the detergent. The detergent may be a laundry detergent, a softener, or the like.

The laundry treatment apparatus 10 according to the embodiments of the present disclosure employs the dispensing system of the laundry treatment apparatus 10 according to the above-mentioned embodiments of the present disclosure. The dispensing system has the advantages of allowing the user to observer the actual dispensing amount and determining the dispensing amount as desired, low manufacturing costs, and the like.

Other components and operations of the laundry treatment apparatus 10 according to the embodiments of the present disclosure are known to those of ordinary skill in the art, and thus details thereof will be omitted herein.

In the description of the present disclosure, it should be understood that, the orientation or the position indicated by terms such as "center," "longitudinal," "lateral," "length," "width," "thickness," "over," "below," "front," "rear," "left," "right," "vertical," "horizontal," "top," "bottom," "inner," "outer," "clockwise," "anti-clockwise," "axial," "radial," and "circumferential" should be construed to refer to the orientation and the position as shown in the drawings, and is only for the convenience of describing the present disclosure and simplifying the description, rather than indicating or implying that the associated device or element must have a specific orientation, or be constructed and operated in a specific orientation, and therefore cannot be understood as a limitation of the present disclosure.

In addition, terms "first" and "second" are only used for descriptive purposes, and cannot be understood as indicating or implying relative importance or implicitly indicating the number of the indicated technical features. Therefore, the features associated with "first" and "second" may explicitly or implicitly include at least one of the features. In the description of the present disclosure, "plurality" means at least two, unless otherwise specifically defined.

In the present disclosure, unless otherwise clearly specified and limited, terms such as "install," "connect," "couple," "fix" and the like should be understood in a broad sense. For example, it may be a fixed connection or a detachable connection or connection as one piece; mechanical connection or electrical connection; direct connection or indirect connection through an intermediate; internal communication of two components or the interaction relationship between two components. For those of ordinary skill in the art, the specific meaning of the above-mentioned terms in the present disclosure can be understood according to specific circumstances.

In the present disclosure, unless expressly stipulated and defined otherwise, the first feature "on" or "under" the second feature may mean that the first feature is in direct contact with the second feature, or the first and second features are in indirect contact through an intermediate. Moreover, the first feature "above" the second feature may mean that the first feature is directly above or obliquely above the second feature, or simply mean that the level of the first feature is higher than that of the second feature. The first feature "below" the second feature may mean that the first feature is directly below or obliquely below the second feature, or simply mean that the level of the first feature is smaller than that of the second feature.

Reference throughout this specification to "an embodiment," "some embodiments," "an example," "a specific example," or "some examples" means that a particular feature, structure, material, or characteristic described in connection with the embodiment or example is included in at least one embodiment or example of the present disclosure. The appearances of the above phrases in various places throughout this specification are not necessarily referring to the same embodiment or example. Furthermore, the particular features, structures, materials, or characteristics may be combined in any suitable manner in one or more embodiments or examples. In addition, different embodiments or examples and features of different embodiments or examples described in the specification may be combined by those skilled in the art without mutual contradiction.

Although the embodiments of the present disclosure have been shown and described above, it should be understood that the above-mentioned embodiments are exemplary and should not be construed as limiting the present disclosure. Those of ordinary skill in the art can make changes, modifications, substitutions, and alternations to the above-mentioned embodiments within the scope of the present disclosure.

What is claimed is:

1. A dispensing system comprising:

a liquid storage box having a liquid storage cavity and a liquid outlet in communication with the liquid storage cavity;

a liquid mixing box having a liquid mixing cavity and a liquid inlet and a mixed liquid outlet that are in communication with the liquid mixing cavity, the liquid mixing box including a visible region through which the liquid mixing cavity is observable; and a dispensing device connected to the liquid outlet and the liquid inlet, the dispensing device being configured to deliver a detergent in the liquid storage cavity to the liquid mixing cavity, and the liquid outlet of the liquid storage box being located at a position higher than the liquid inlet of the liquid mixing box in a vertical direction.

2. The dispensing system according to claim 1, wherein a scale marker is provided in the visible region.

3. The dispensing system according to claim 2, wherein the scale marker includes a detergent amount marker.

4. The dispensing system according to claim 2, wherein the scale marker includes a laundry metering marker, and the laundry metering marker includes an amount of laundry, a weight of the laundry, or a volume of the laundry.

5. The dispensing system according to claim 2, wherein the scale marker includes an inflow water volume marker or an inflow water level marker.

6. The dispensing system according to claim 2, wherein the scale marker includes at least one of a word, a number, a symbol, or a pattern.

7. The dispensing system according to claim 2, wherein the scale marker includes a plurality of primary scales, each of the plurality of primary scales including at least one secondary scale.

8. The dispensing system according to claim 1, wherein:

the liquid mixing box has a siphonage passage communicating the liquid mixing cavity and the mixed liquid outlet;

the liquid mixing box includes:

a box body having the liquid mixing cavity;

a communication pipe connected to the box body, the communication pipe having a lower end formed as the mixed liquid outlet and an upper end located in the liquid mixing cavity; and a siphonage cap disposed in the liquid mixing cavity, the siphonage cap being arranged around and spaced apart from the communication pipe, the siphonage passage including a first channel formed in the communication pipe and a second channel formed between the communication pipe and the siphonage cap;

a bottom wall of the box body has an accommodation recess recessed downwards;

the lower end of the communication pipe is connected to a bottom wall of the accommodation recess; and the upper end of the communication pipe is located at an upper part of the liquid mixing cavity.

9. The dispensing system according to claim 1, wherein:

the liquid mixing box has an overflow opening in communication with the liquid mixing cavity, the overflow opening being formed at an upper part of a side wall of the liquid storage box;

the liquid mixing box has an upper end opened to form the liquid inlet; and the liquid outlet is located at a bottom of the liquid storage box.

10. The dispensing system according to claim 1, wherein:

the storage box is one of a plurality of liquid storage boxes of the dispensing system; and the liquid mixing box is one of a plurality of liquid mixing boxes of the dispensing system, the plurality of liquid mixing boxes corresponding to the plurality of liquid storage boxes, respectively.

11. The dispensing system according to claim 1, wherein the dispensing device includes:

a dispensing assembly; and a drive assembly including a driver in a transmission connection with the dispensing assembly, the driver being configured to move to drive the dispensing assembly to dispense the detergent.

12. The dispensing system according to claim 11, wherein:

the driver includes an electrically operated driver; and the drive assembly further includes a controller connected to the electrically operated driver, the controller being configured to control the electrically operated driver to be switched on or switched off.

13. The dispensing system according to claim 11, wherein:

the driver includes a manually operated driver; and the drive assembly further includes a transmission assembly located between the driver and the dispensing assembly, the transmission assembly being fixedly arranged relative to the dispensing assembly and being in a transmission connection with the driver.

14. The dispensing system according to claim 13, wherein:

the transmission assembly includes a first transmission member;

the driver includes a second transmission member; and the first transmission member is engaged with or abuts against the second transmission member.

15. The dispensing system according to claim 14, wherein:

the first transmission member includes a gear, and the second transmission member includes a rack disposed at the driver, the rack extending in a movement direction of the driver; or the first transmission member includes a ratchet, and the second transmission member includes a pawl.

16. The dispensing system according to claim 11, wherein:

the drive assembly further includes an elastic restoring member, the elastic restoring member being connected to the driver or formed by at least part of the driver;

the driver has a straight movement trajectory, a curved movement trajectory, or a combination of the straight movement trajectory and the curved movement trajectory; and the dispensing assembly includes a housing, the driver being located outside the housing or formed as a part of the housing.

17. The dispensing system according to claim 1, wherein the dispensing assembly includes a compartmentalizer including a plurality of compartments, each of the plurality of compartments having a communication opening at a peripheral side wall of the compartment and being in communication with the liquid outlet through the communication opening.

18. A laundry treatment apparatus comprising:

a machine body having a laundry treatment cavity; and the dispensing system according to claim 1.

19. The dispensing system according to claim 1, further comprising:

a liquid inlet pipe connected between the dispensing device and the liquid outlet, the liquid inlet pipe being a horizontal pipe.

20. A dispensing system comprising:

a liquid storage box having a liquid storage cavity and a liquid outlet in communication with the liquid storage cavity;

a liquid mixing box having a liquid mixing cavity and a liquid inlet and a mixed liquid outlet that are in communication with the liquid mixing cavity, the liquid mixing box including a visible region through which the liquid mixing cavity is observable;

a dispensing device connected to the liquid outlet and the liquid inlet, the dispensing device being configured to deliver a detergent in the liquid storage cavity to the liquid mixing cavity; and a liquid inlet pipe connected between the dispensing device and the liquid outlet, the liquid inlet pipe being a horizontal pipe.

* * * * *